United States Patent [19]

Zalut

[11] Patent Number: 4,984,699

[45] Date of Patent: Jan. 15, 1991

[54] TAMPER EVIDENT CAP

[76] Inventor: Gregory J. Zalut, 24640 Laetham, East Detroit, Mich. 48021

[21] Appl. No.: 381,206

[22] Filed: Jul. 18, 1989

Related U.S. Application Data

[63] Continuation-in-part of Ser. No. 201,329, May 27, 1989, Pat. No. 4,874,101.

[51] Int. Cl.[5] ..... B65D 41/34

[52] U.S. Cl. ..... 215/231; 53/490; 215/251

[58] Field of Search ..... 53/490; 215/217, 251, 215/253; 220/257, 266

[56] References Cited

U.S. PATENT DOCUMENTS

| | | | |
|---|---|---|---|
| 2,124,873 | 7/1938 | Conner | 215/251 |
| 2,124,874 | 7/1938 | Conner et al. | 215/251 |
| 2,162,752 | 6/1939 | Schauer | 215/251 X |
| 2,684,168 | 7/1954 | McGinnis et al. | 215/330 |
| 3,329,295 | 7/1967 | Fields | 215/252 |
| 4,433,790 | 2/1984 | Gibson | 215/251 X |
| 4,682,700 | 7/1987 | Montgomery et al. | 215/217 X |

*Primary Examiner*—Stephen Marcus

*Attorney, Agent, or Firm*—Reising, Ethington, Barnard, Perry & Milton

[57] ABSTRACT

A container and cover combination and method of assembling the same is disclosed. The container and cover combination include a container 12 having a neck portion 20 defining an opening 22 into the container 12. A removeable cover 16 is fastened onto the neck portion 20. The cover assembly includes a tamper evident mechanism for indicating an attempted opening of the cover assembly. The tamper evident mechanism includes a substantially cup-shaped cap member 18 having a fractureable portion 30 and one way threads for locking the cap member 18 against unthreading from the neck portion 20 when the cap member 18 is rotated in one direction relative to the neck portion 20 and for forcing the cap member 18 further onto the neck portion to fracture the fractureable portion 30 when the cap member 18 is rotated in the opposite direction relative to the neck portion 20 thereby evidencing the attempt at opening.

14 Claims, 2 Drawing Sheets

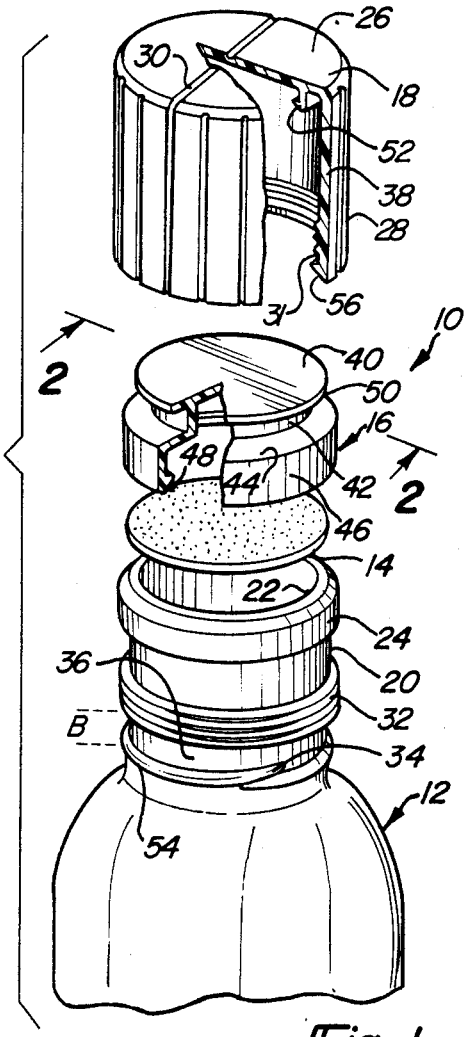
Fig-1
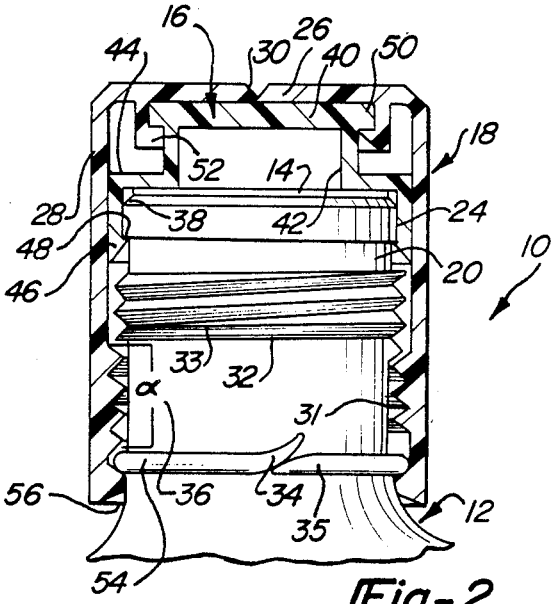
Fig-2
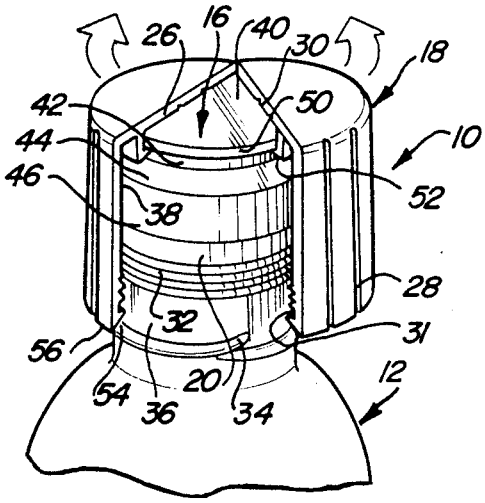
Fig-3
Fig-4
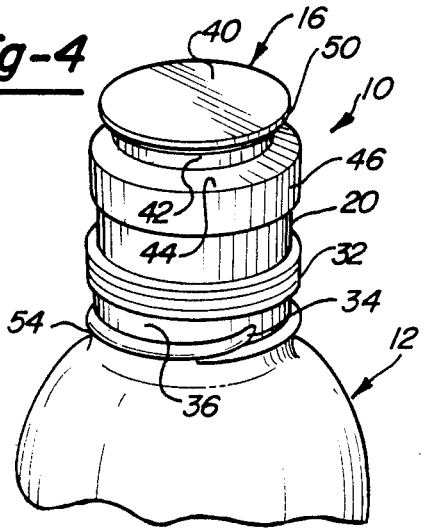
Fig-5
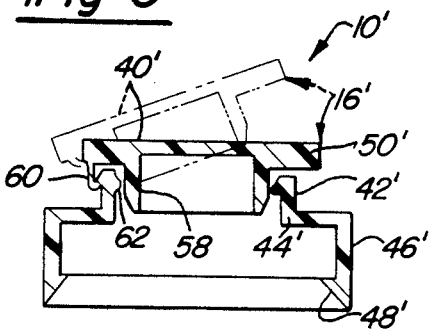

TAMPER EVIDENT CAP

This application is a continuation-in-part of serial number 07/201,329, filed May 27, 1989, now patent No. 4,874,101, issued Oct. 17, 1989.

TECHNICAL FIELD

This invention relates to container and cover combinations, and more particularly, the invention relates to caps for bottles which indicate if there has been any tampering of the bottle by attempted removal of the cap.

BACKGROUND ART

Many devices have been constructed to indicate the attempted tampering of containers. Generally, an outer cap member is disposed over an inner fitment. The outer cap member provides a seal which when ruptured indicates tampering. The inner fitment provides a cover to the container which in most cases is removable and resealable. The outer cap may be ruptured by various means. In most instances, the cover is ruptured during the unscrewing process.

For example, U.S. Pat. No. 2,124,874 to Conner et al, issued July 26, 1938, discloses a container closure including an inner fitment and an indicator member. The fitment is covered or at least partly covered by the indicator member or outer closure.

The U.S. Pat. No. 2,162,752 to Schauer, issued June 20, 1939, discloses a tamper proof closure wherein the closure snaps over a rim of the inner fitment.

The U.S. Pat. No. 4,433,790 to Gibson, issued Feb. 28, 1984, discloses a tamper proof closure wherein the outer indicator cap is snapped onto the inner fitment prior to assembly.

None of the aforementioned patents disclose a one way screw on outer indicator cap which is not removable by reverse screwing and has a central weakened portion so that tightening of the cap over a second series of threads splits the cap.

SUMMARY OF THE INVENTION

The present invention provides a container and cover combination including a container having a neck portion defining an opening into the container and removeable cover means fastened onto the neck portion for covering the opening. The cover means includes tamper evident means for indicating an attempted opening of the cover means. The tamper evident means includes a substantially cup-shaped cap member having a base portion and an annular flange portion thereabout and a fractureable portion and one way threading means for locking the cap member against unthreading from the neck portion when the cap member is rotated in one direction relative to the neck portion and for forcing the cap member further onto the neck portion to fracture the fractureable portion when the cap member is rotated in the opposite direction relative to the neck portion thereby evidencing an attempted opening of the container.

FIGURES IN THE DRAWINGS

FIG. 1 is a perspective view partially broken away and in cross section of the present invention;

FIG. 2 is a cross sectional view taken substantially along lines 2—2 of FIG. 1;

FIG. 3 is a perspective view of the present invention wherein the cap member is fractured by attempted opening of the closure;

FIG. 4 is a perspective view of the present invention with the cap member removed; and FIG. 5 is a cross sectional elevational view of a second embodiment of the fitment member of the present invention;

DETAILED DESCRIPTION OF THE DRAWINGS

Figure 6:
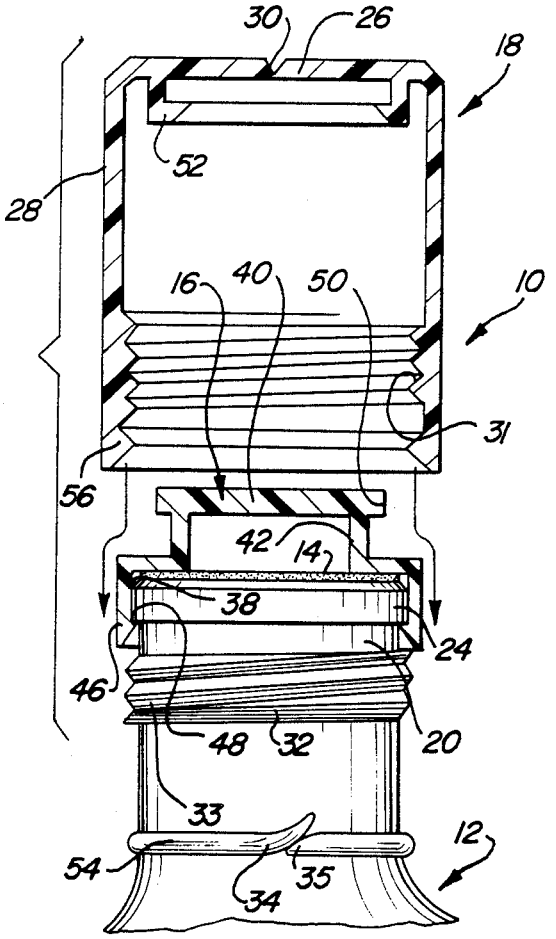
FIG. 6 is an elevational view partially in cross section of the cap member being disposed above the cover member of the present invention prior to assembly.

A container and cover combination constructed in accordance with the present invention is generally shown at 10 in the Figures. Primed numbers are used to show like structure between the two embodiments.

The assembly generally includes a container generally indicated at 12, a seal 14, a cover member or fitment 16, and a cap member generally indicated at 18. The container 12 includes a neck portion 20 defining an opening 22 into the container 12. The container 12 is shown as a glass bottle, may be made in other forms and from other materials.

The removable cover 16 is fastened onto a lip 24 extending radially outwardly from the neck portion 20 for covering the opening 22.

The assembly 10 includes tamper evident means for indicating an attempted opening of the cover assembly. The tamper evident means includes the substantially cup-shaped cap member 18 having a base portion 26 and annular skirt or flange portion 28 thereabout. The cap member 18 further includes a fractureable portion 30 and one way threading means for locking the cap member 18 against unthreading from the neck portion 20 when the cap member 18 is rotated in one direction relative to the neck portion 20 and for forcing the cap member 18 further onto the neck portion 20 to fracture the fractureable portion 30 when the cap member 18 is rotated in the opposite direction relative to the neck portion 20 thereby evidencing the attempted opening. In other words, when the cap member 18 is screwed in the counter-clockwise direction, the cap member 18 cannot be removed. When the cap member 18 is screwed in a clockwise direction relative to the neck portion 20, the cap member 18 is fractured thereby evidencing tampering.

The one way threading means includes a threaded flange portion 31 of the cap member 18. The neck portion 20 includes spaced first and second one way threads 32,34, respectively separated by a smooth unthreaded portion 36. The threads 32,34 include an open upper thread portion for threadibly receiving the inner thread 31 of the cap member 18. The threads 32,34 further includes a closed end portion which threads onto itself. This end portion allows the thread 31 to pass thereover but once passed over, it does not allow the thread 31 to be reentrained thereover in the reverse direction. There is no origin on threads 32,34 for rethreading in the reverse direction for removal of the cap 18. In other words, each thread 32,34 includes an upper helical or thread portion. The last lowest turn of the thread closes on the thread thereabout to form a bottom bead in a single plane. Once the thread of the cap is threaded on the helical portion, it is forced over the bead. Once the thread is completely past the bead, the bead prevents reverse threading back over the helical portion because the bead provides no origin to the thread. Hence, the thread entrained over the helical portion can be forced over the bead portion but once completely threaded thereover the bead prevents rethreading in the reverse direction. The threaded flange portion 31 of the cap member 18 has a predetermined height. The cap member 18 includes an unthreaded portion 38 between the base portion 26 and the threaded flange portion 31. The smooth portion 36 of the neck portion has a height of the threaded flange portion 31 which is slightly less than the height of the threaded flange portion 31 so that the threaded flange portion 31 engages the second thread 34 as the threaded flange portion 31 is screwed beyond the first thread 32 and over the smooth portion 36. At the point of application of the cap member 18, the threaded flange 31 disengages the first thread 32 as it begins to engage the second one way thread 34.

The cover member 16 is disposed within the cap member 18 and mounted on the peripheral lip 24. As the cap member 18 is screwed further onto the second one way thread 34, the cap member 18 is forced over the cover member 16. The continued force between the cap member 18 and cover member 16 fractures the fractureable portion 30 of the cap member 18, as discussed below.

The cover member 16 includes a top portion 40 and an annular wall 42 extending therefrom. A radially outwardly extending wall 44 extends from the wall 42. A second annular wall 46 extends downwardly from the wall 44. A shoulder 48 extends radially inwardly from the annular wall 46. The shoulder 48 is a peripheral portion of the cover member 16 which engages the lip portion 24 of the neck portion 20. The cover member 16 is made from a flexible material such that the shoulder 48 can be snapped onto and snapped off of the lip portion 24 for removal and re-application of the cover member 16 onto the neck portion 20 to cover the opening 22. The seal 14 is applied over the opening 22 during the initial closing of the assembly during production and is removed upon the initial opening of the assembly prior to use.

The cap member 18 includes fastening means for fastening the top portion 40 of the cover member 16 against the base portion 26 of the cap member 18. The fastening means includes an annular fastening flange 50 extending radially outwardly from the top portion 40. The cap member 18 includes a plurality of flexible fingers 52 extending from the base portion 26 thereof for securely engaging in fastening the flange 50 once the fastening flange 50 is snapped the grip of the fingers 52. The fastening means can take other forms. For example, an annular flange can extend downwardly from the base portion 26 having a radially inwardly extending shoulder for engaging the fastening flange 50, as opposed to a plurality of fingers.

The cover member 16 and the unthreaded portion 38 of the cap member 18 have predetermined heights so that the shoulder 48 of the annular wall 46 of the cover member 16 engages against the lip portion 24 of the neck portion 20 when the threaded flange portion 31 is threaded over the first thread 32 and so that the shoulder 48 engages over the lip portion 24 when the threaded flange portion 31 is threaded beyond the first thread 32 and engages the second thread 34. As described below, this coordination of heights of various portions of the cover member 16 and cap member 18 provide engagement of the cover member 16 fixedly over the opening 22 as the cap member 18 is secured over the second one way thread 34.

The fractureable portion 30 includes a weakened line 30 extending across the base portion 26 of the cap member 18 and down the opposing unthreaded threaded flange portions 38,31 respectively of the downwardly extending annular wall 28 of the cap member 18.

The second thread 34 comprises an enlarged finishing ring 54. The threaded flange 31 includes a peripheral bead 56 for snapping over the finishing ring 54 without fracturing the fractureable portion 30 to lock the cap member 18 on the second thread 34 and to fracture the cap member 18 upon further rotation of the cap member 18 relative to the neck portion 20.

A second embodiment of the cover member is generally shown at 10' in FIG. 5. The top portion 40' includes an annular wall 58 extending downwardly therefrom. The top portion 40' is integrally connected to the annular wall 42' by a flexible connecting portion 60. The annular wall 58 is secured within the annular wall 42' by a detant 62. As shown in hatched lines, the top portion 40' is removeable. This is the preferred structure for containing liquids whereas the first embodiment is generally used for the containment of solids.

In use, the assembled cover and container assembly is shown in FIG. 2. Counterclockwise rotation of the cover member over the second one way thread 34 does not disengage the peripheral thread 56 from the second thread 34 or the finishing ring 54. This is because there is no origin for the threads to become entrained upon. Further, the threaded flange 31 cannot re-engage the first one way thread 32 because it has no origin in reentrainment. The flange 31 cannot reversibly thread over the bottom-most bead portion of the thread. The shoulder 52 allows rotation over the cover member 16 while maintaining the cap member 18 in engagement with the cover member 16. Clockwise rotation of the cap member 18 relative to the neck portion 20 forces the threaded flange portion 31 further into engagement with the finishing ring 54 and onto and over the finishing ring 54. The enlarged finishing ring 54 fractures the fractureable portion 30 along the threaded flange thereby evidencing tampering. Responsible removal of the cap member 18 merely requires rotation of the cap member 18 and the eventual complete splitting of the cap member 18 as shown in FIG. 3. Thus, the thread 32 first engages the cap and then prevents its removal, and the enlarged finishing ring fractures the cap. The lip 56 perfects a seal below the finishing ring. FIG. 4 shows the cap member 18 removed from the assembly 10. Access to the contents of the container 12 is obtained by the snapping off of the cover member 16 or disengagement of the top portion 40' of the cover member 16' as shown in FIG. 5.

Figure 7:
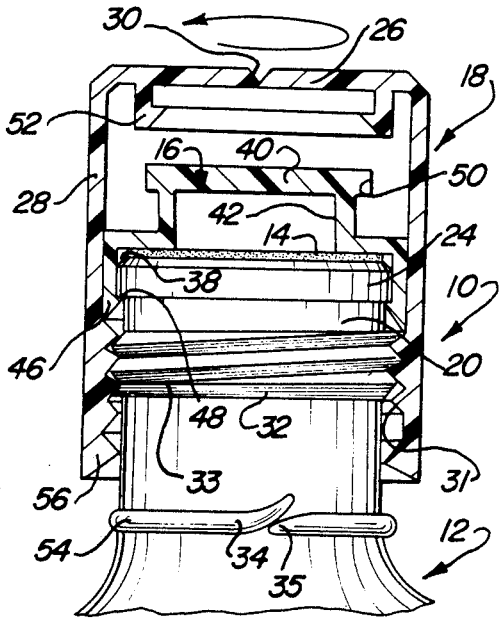
FIG. 7 is an elevational view partially in cross section of the cap member partially disposed over the neck portion of the container.
Figure 8:
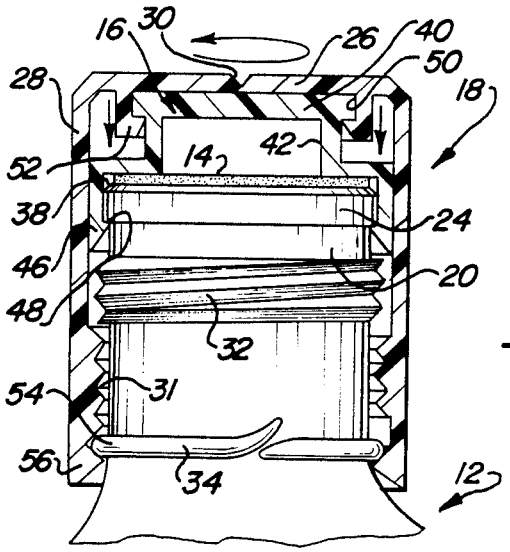
FIG. 8 is an elevational view partially in cross section of the cover member of the present invention locked on the neck portion of the container.

The present invention further provides a method of assembling the container and closure combination shown in FIGS. 6–8, generally including the steps of screwing the tamper evident cap member 18 having the fractureable portion 30 onto the neck portion 20 of the container 12 and locking the cap member 18 on the second one way thread 34 against unthreading from the neck portion 20 when the cap member 18 is turned in one direction relative to the neck portion 20 while allowing the cap member 18 to be threaded further onto the one way thread 34 to force the cap member 18 further onto the neck portion 20 to fracture the fractureable portion 30 when the cap member 18 is rotated in the opposite direction relative to the neck portion 20. More specifically, and as shown in FIGS. 6 and 7 the threaded flange portion 31 of the cap member 18 is screwed over the first one way thread 32 on the neck portion 20 and then engages the second one way thread 34 when the threaded flange portion 31 is threaded beyond the first thread 32. As shown in FIG. 8, the peripheral end 56 of the threaded flange 31 threaded over and is locked over the second one way thread 34 against the enlarged finishing ring 54. As shown in FIG. 8, in this position the threaded flange 31 is threaded beyond the one way thread 32. Since the thread 32 has no origin at its bottom for thread 31 to reengage, the cap member 18 is allowed to rotate counterclockwise in one direction while rotation in the clockwise opposite direction forces the threaded flange 31 over the finishing ring 54 which fractures the fractureable portion 30.

During the assembly and as shown in FIgures 7 and 8, the removeable cover 16 is secured within the cap member 18 and then the cover member 16 is fastened to the neck portion 20 as the cap member 18 is screwed beyond the first thread 32 and onto the second thread 34. More specifically, the method includes the step of snapping the annular flange 50 of the cover member 16 into the plurality of fingers 52 within the cap member prior to screwing the cap member 18 onto the neck portion 20 as shown sequentially from FIGS. 7 to FIG. 8. Specifically, the annular shoulder 48 of the cover member 16 is force fit over the outwardly radially extending lip 24 on the neck portion 20 as the peripheral portion 56 of the threaded flange 31 is screwed onto the second thread 34 on the neck portion 20.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A container and cover combination (10) comprising: a container (12) including a neck portion (20) defining an opening (22) into said container (12); removeable cover means (16) fastened onto said neck portion (20) for covering said opening (22); said cover means including tamper evident means for indicating an attempted opening of said cover means, characterized by said tamper evident means including a substantially cup-shaped cap member (18) having a base portion (26) and an annular flange portion (28) thereabout and a fractureable portion (30) and one way threading means for locking said cap member (18) against unthreading from said neck portion (20) when said cap member (18) is rotated in one direction relative to said neck portion (20) and for forcing said cap member (18) further into said neck portion (20) to fracture said fractureable portion (30) when said cap member (18) is rotated in the opposite direction relative to said neck portion (20) thereby evidencing the attempted opening.

2. A container as set forth in claim 1 further characterized by said one way threading means including a threaded flange portion (31) of said cap member (28) and said neck portion (20) including spaced first and second one way threads (32,34) separated by a smooth portion (36).

3. A container as set forth in claim 2 further characterized by said threaded flange portion (31) having a predetermined height of the threaded flange portion 31 said cap member (18) including an unthreaded portion (38) between said base portion (26) and said threaded flange portion (31), said smooth portion (36) having a height which is slightly less than said height of said threaded flange portion (31) engaging said second thread (34) as said threaded flange portion (31) is screwed beyond said first thread (32) and over said smooth portion (36).

4. A container as set forth in claim 3 further characterized by said neck portion (20) including a peripheral lip (24), said cover means including a removeable cover member (16) disposed within said cap member (18) and mounted on said peripheral lip (24), said cap member (18) being forced over said cover member (16) when said cap member is screwed onto said second thread to fracture said fractureable portion (30) of said cap member

5. A container as set forth in claim 4 further characterized by said cover member (16) including a top portion (40) and a substantially annular wall (46) having a peripheral portion (48) engaging said lip portion (24) of said neck portion (20), said cap member (18) including fastening means for fastening said top portion (40) of said cover member (16) against said base portion (26) of said cap member (18).

6. A container as set forth in claim 5 further characterized by said cover member including an annular fastening flange (50) extending radially outwardly from said top portion (40), said cap member (18) including a plurality of flexible fingers (52) extending from said base portion (26) thereof for securely engaging said fastening flange (50) once said fastening flange (50) is snapped into the grip of said fingers (52).

7. A container as set forth in claim 6 further characterized by said cover member (16) and said unthreaded portion (38) of said cap member (18) having predetermined heights to have said peripheral portion (48) of said annular wall (46) of said cover member (16) engaged against said lip portion (24) of said neck portion (20) when said threaded flange portion (31) is threaded over said first thread and to have said peripheral portion (48) engaged over said lip portion (24) when said threaded flange portion (31) is threaded beyond said first thread (32) and engaging said second thread (36).

8. A container as set forth in claim 1 further characterized by said fractureable portion (30) including a weakened line (30) extending across said base portion (26) of said cap member (18) and down opposing unthreaded and threaded flange portions (38,31) of said cap member (18).

9. A container as set forth in claim 8 further characterized by said tamper evident means further including an enlarged finishing ring (54) integral with the end of said one way threading means and said cap member including a peripheral portion (56) for snapping over said finishing ring (54) without fracturing said fractureable portion (30) to hook said cap member (18) on said one way threading means (34) and for fracturing said cap member (18) upon further rotation of said cap member (18) relative to said neck portion (20).

10. A method of assembling a container and closure combination including the steps of: screwing a tamper evident cap member (18) having a fractureable portion (30) onto a neck portion (20) of a container (12); and locking the cap member (18) on a one way thread (34) against unthreading from the neck portion (20) when the cap member (18) is turned in one direction relative to the neck portion (20) while allowing the cap member (18) to be threaded further onto a one way thread (34) to force the cap member (18) further onto the neck portion (20) to fracture the fractureable portion (30) when the cap member (18) is rotated in the opposite direction relative to the neck portion (20).

11. A method as set forth in claim 10 wherein said screwing step is further defined as screwing a threaded flanged portion (31) of the cap member (18) over a first one way thread (32) on the neck portion (20) and engaging a second one-way thread (34) when the threaded flange portion (31) is threaded beyond the first thread (32).

12. A method as set forth in claim 11 further including the step of securing a removeable cover member (16) within the cap member (18) and fastening the cover member (16) to the neck portion (20) as the cap member (18) is screwed beyond the first thread (32) and onto the second thread (34).

13. A method as set forth in claim 12 wherein said securing step is further defined by snapping an annular flange (50) of the cover member (16) into a plurality of fingers (52) within the cap member (18).

14. A method as set forth in claim 13 wherein said fastening step is further defined as force fitting an annular shoulder (48) about the base of the cover member (16) over an outwardly radially extending lip (26) on the neck portion (20) as the peripheral portion (56) of the threaded flange (31) of the cap member (11) is screwed onto the second thread (34) on the neck portion (20).

* * * * *